US005920843A

United States Patent [19]

Fay

[11] Patent Number: 5,920,843

[45] Date of Patent: Jul. 6, 1999

[54] SIGNAL PARAMETER TRACK TIME SLICE CONTROL POINT, STEP DURATION, AND STAIRCASE DELTA DETERMINATION, FOR SYNTHESIZING AUDIO BY PLURAL FUNCTIONAL COMPONENTS

[75] Inventor: Todor C. Fay, Redmond, Wash.

[73] Assignee: Mircrosoft Corporation, Redmond, Wash.

[21] Appl. No.: 08/880,868

[22] Filed: Jun. 23, 1997

[51] Int. Cl.[6] ..... G10H 1/02; G10L 3/02

[52] U.S. Cl. ..... 704/503; 84/624; 84/627

[58] Field of Search ..... 704/503; 84/624, 84/625, 627, 645

[56] References Cited

U.S. PATENT DOCUMENTS

| | | | |
|---|---|---|---|
| 5,631,434 | 5/1997 | Hiroyuki | 84/661 |
| 5,665,928 | 9/1997 | Wang | 84/621 |
| 5,742,695 | 4/1998 | Suggs | 381/104 |
| 5,744,742 | 4/1998 | Lindemann et al. | 84/623 |

OTHER PUBLICATIONS

Masaru Kamada, Takahiro Yamada, and Ken–Ichi Takahashi, "A Scheme of Discretization and Reconstruction of Signals", Proc. 22nd International Conference on Industrial Electronics, Control, and Instrumentation (IECON), pp. 1661–1668, Aug. 1996.

*Primary Examiner*—David R. Hudspeth
*Assistant Examiner*—Tālivaldis Ivars Ŝmits
*Attorney, Agent, or Firm*—Jones & Askew

[57] ABSTRACT

The present invention provides a system and a method for tracking parameters of a synthesized [an] audio signal that reduces the amount of processing time without causing any discernible degradation in the sound quality of the audio signal. An audio signal is intelligently divided into multiple time slices and the parameters of the audio signal are tracked over the duration of the time slice. The time slices are selected so that the actual characteristic of the parameters over the duration of the time slice can be easily approximated by performing simple, non-processor intensive steps. The characteristics of various components of an audio signal such as a volume envelope, pitch envelope, low frequency oscillator, MIDI commands controlling the audio signal, and various other inputs are used to identify control points. Adjacent control points are then selected as the start point and end point of a time slice. Absolute values for the start point and the end point of the time slice are used to determine a step duration and a step delta. The parameters of the audio signal are tracked by using the absolute values for the start point of the time slice to generate initial control signals for the audio signal at the start point of the time slice. Then, the control signals are modified by the step delta at every step duration to the end point of the time slice.

60 Claims, 7 Drawing Sheets

SIGNAL PARAMETER TRACK TIME SLICE CONTROL POINT, STEP DURATION, AND STAIRCASE DELTA DETERMINATION, FOR SYNTHESIZING AUDIO BY PLURAL FUNCTIONAL COMPONENTS

TECHNICAL FIELD

The present invention relates to audio signaling and, more particularly, relates to tracking parameters, including volume and pitch, of an audio signal in a manner that reduces the amount of required processing.

BACKGROUND OF THE INVENTION

The role of software as a key component in high-tech, electronic products is increasing at a rapid rate. One reason for this increase may be attributed to competition for market share. For instance, companies continuously strive to deliver new products with more features in a quicker turn-around time than their competitors. The use of software within an electronic product makes this possible. By changing the software, a manufacturing company can produce a new product with a new set of features without having to change the hardware and hence, the production line. Overall, this improves the turn-around time in delivering new products.

Music synthesizers are one example of products in which the use of software is becoming more significant. In fact, software synthesizers that can be installed and operated from a single computer equipped with an audio sound card are now available for purchase. In hardware based synthesizers, the volume and pitch of the audio signal can easily be tracked at the sample rate of the audio signal (i.e. 44 KHz). In software based synthesizers, however, tracking the volume and pitch at the sample rate is processor intensive. This is amplified by the requirement of the CPU to monitor key presses, key releases, as well as performing the arbitration between the various processes and components of the synthesizer.

Several technological issues must be addressed in developing a software synthesizer. Many of these issues are complicated by the contradictory requirements of producing quality and consistent musical sounds, while minimizing the amount of processing resources required. These requirements are contradictory because, in general, the very steps required to improve the quality and consistency of the sound result in using more processing time. As a result, typical software synthesizers may be limited in the amount of features provided, the quality of the sound, or the sophistication of the synthesis process. One method to alleviate this problem is by improving the efficiency of the processing unit running the software synthesizer. However, there is also a need to improve the performance of a software synthesizer by decreasing the amount of processing time required to produce quality and consistent sound.

A typical synthesizer produces an audio signal by generating a pitch signal having the desired frequency characteristics and a volume signal for controlling the output volume level. These signals are then input to an amplifier along with a digital audio source. The digital audio source is modulated by the pitch and volume signals to produce the audio signal. In digital electronic based synthesizers, the sound and volume signals are discrete signals rather than continuous. Thus, the pitch and volume of the audio signal are provided to the amplifier in various samples at a sample rate. A typical sample rate for synthesizers is 44 KHz.

The level for the pitch and volume signals at each of the sample points are generated by combining several pieces of information. For instance, the level of the pitch signal at any one sample point can include a combination of one or more of the following input parameters: the note being played, the position of a pitch wheel, the effect of an LFO on the vibrato, the state of a pitch envelope, MIDI pitch bend events, or other similar parameters. Likewise, the level of the volume signal at any one sample point can include a combination of one or more of the following input parameters: the pan setting, the attenuation setting, the effect of an LFO on the tremolo, the volume setting, MIDI expression events, or other similar parameters. Thus, for each sample point, the value for each of the required parameters must be determined and then combined to produce the signals.

In a predominantly hardware based synthesizer, the process of combining the various parameters can easily be accomplished using synchronized adder circuits, shift registers, multipliers, and analog to digital converters where necessary. However, in a predominantly software based synthesizer, this process can be very processor intensive. If the sample rate is too fast, the software synthesizer may not be able to process the information in real time. At a minimum, the software synthesizer must limit the available features due the heavy demand on the processor for simply synthesizing the audio signal. Thus, there is a need for a method to produce an audio signal with a software synthesizer that limits the amount of processing resources required to synthesize the audio signal.

One technique for limiting the amount of processor time required to synthesize an audio signal is to decrease the sample rate. Another technique is to only track the pitch and volume at step points of more than one sample point. Both of these techniques significantly reduce the amount of processing time required, but under certain circumstances the quality and consistency of the audio signal may be compromised. For instance, when the pitch or the volume of the audio signal is changing rapidly, reducing the sample rate or increasing the step size between step points may result in eliminating significant details of the audio signal. In addition, if the pitch or the volume changes a significant amount between sample points, then the audio signal may sound choppy. On the other hand, under certain circumstances, the pitch and the volume of an audio signal change at a relatively low rate. Thus, not only is it processor intensive to track the audio signal at the sample rate, it is also unnecessary in many circumstances.

Therefore, there may be seen a need in the art for a system and method for tracking the pitch and volume of an audio signal that minimizes the processing time, but maintains an accurate track of the actual audio signal.

SUMMARY OF THE INVENTION

The present invention provides a system and a method for accurately tracking the pitch and volume of an audio signal while reducing the amount of processor time required to synthesize an audio signal. This is accomplished by: (1) intelligently selecting points in time at which to adjust the parameters of an audio signal; and (2) intelligently tracking the changes in these parameters between these points.

In one embodiment, the invention can be implemented within one or more software modules operating within a software synthesizer program. Digital information representing an audio signal is received by the program. The digital information may be received in a digital data stream, generated in real time, or from a pre-recorded file on a storage medium. Among other items, the digital information includes MIDI events. In response to receiving a MIDI note on event, the program defines the start point for a time slice as the time of the reception of the MIDI note on event. The start point of the time slice is then passed as a parameter in a call to an articulation generator module.

The articulation generator module receives the start point identifying a particular time. The digital information also represents various components of the audio signal with each component having one or more control points. The components of the audio signal may include MIDI events, a volume envelope, a pitch envelope, a low frequency oscillator signal, and status signals from at least one external source. The articulation generator module forward scans the digital information to locate the time of the next occurring control point for each component of the audio signal. These control points are then returned to the calling routine along with the absolute values for the volume level and the pitch level at the start point.

The program then equates the end point of the time slice to the time of the earliest occurring control point of the returned control points. The end point of the time slice is then passed as a parameter in a second call to the articulation generator. Similar to the first call, the articulation generator returns absolute values for the volume level and the pitch level for the end point of the time slice along with the next occurring control points for each component of the audio signal. Finally, the volume and pitch levels are tracked by calling a mix engine module with the absolute values for the volume and pitch levels at the start point and end point of the time slice along with the length of the time slice.

The mix engine receives the absolute values in perceptual units for the volume level and the pitch level for the start point and the end point of a time slice. The volume and pitch levels are then tracked over the duration of the time slice by first determining a step duration. In one embodiment, the step duration is determined by identifying the number of samples that occur, at a given sample rate, during the a time period that the volume level changes a predetermined amount. Likewise, the number of samples that occur at the given sample rate, during a time period that the pitch level changes a predetermined amount is also determined. The step duration is equated to the lesser of these numbers. In an alternative embodiment, the step duration is determined by examining the rate of change of the volume level and the pitch level and setting the step duration to a value that is inversely proportional to the maximum rate of change.

Next, the mix engine equates a volume total delta to the difference between the absolute value for the start point and the absolute value for the end point of the volume level, and a pitch total delta to the difference between the absolute value for the start point and the absolute value for the end point of the pitch level. In one embodiment, each of these total deltas are then converted from perceptual units into linear units. In alternative embodiments, the total deltas are maintained in perceptual units.

A volume step delta and a pitch step delta are determined by dividing the respective total deltas by the number of steps having the step duration that exist over the duration of the time slice. In one embodiment of the present invention, the audio signal is tracked by using perceptual units. In this embodiment, the magnitudes of each of the parameters are provided in perceptual units. A step delta for each of the parameters is determined by dividing the difference in the magnitudes for each parameter at the start point and the end point of the time slice by the number of steps having the step duration that exist over the duration of the time slice. The stepped representation of each of the parameters is provided by setting the magnitude of the first step of step duration of an output signal representing a particular parameter, to the received absolute value of the particular signal parameter at the start point of the time slice. Each subsequent step the output signal representing the particular parameter is then set to the magnitude of the previous step plus the step delta. In this embodiment, the step duration may be increased to a minimum step duration. This step ensures that the processor has enough time to convert the value at each step from perceptual units into linear units.

In another embodiment of the present invention, the audio signal is tracked by using linear units. In this embodiment, the difference in the magnitudes between the start point and the end point of each of the plurality of parameters are converted from perceptual units into linear units prior to determining the step delta. Then, the step delta is equated to the converted difference divided by the number of steps having the step duration that exist over the duration of the time slice. The stepped representation of each of the parameters is provided by setting the magnitude of a first step duration of an output signal representing the particular parameter to the received absolute value of the particular parameter at the start point of the time slice converted into linear units. Each subsequent step duration of the output signal is then set to the magnitude of the previous step duration plus the step delta converted into linear units.

In the embodiment of the present invention where the audio signal is tracked in perceptual units, the first and second predetermined amounts may be selected based on the amount of time required to convert the magnitudes at each step of the stepped representation from perceptual units into linear units. Alternatively and in either embodiment, the first and second predetermined indiscernible amounts can be set to specific values such as 0.01 decibels for the first predetermined indiscernible amount and 0.005 semitones for the second predetermined indiscernible amount.

In yet another embodiment, the audio signal can be tracked in perceptual units or linear units depending on the length of the time slice. Because tracking the audio signal in linear units induces a slight in accuracy in the output signal, if the time slice is substantially long, some degradation in the sound quality may be discerned. Therefore, if the length of the time slice is less than a maximum length, the difference in the magnitudes of the absolute values between the start point and the end point of each of the parameters from perceptual units into linear units prior to determining the step delta. Otherwise, the step delta is determined based on the perceptual units and the output signal at each step is converted to linear units.

Representations for the volume level and the pitch level are then provided by setting the volume level and the pitch level associated with the start point of the particular time slice to the linear units equivalent of the received absolute values for the start point. At each step point after the start point, the magnitude of the volume level and the pitch level are set to the sum of the value of the previous step point and either the volume step delta or the pitch step delta. At the end point of the time slice, the volume level and the pitch level are set to the linear units equivalent of the received absolute volume level and pitch level for the end point. In one embodiment, the calculations involved in this process are all performed in linear units. This advantageously simplifies the math and hence, reduces the processing time. However, in alternative embodiments, the calculations can be performed in perceptual units. This has the advantage of more accurately tracking the audio signal.

The present invention uses a standard four segment envelope for the pitch and volume levels. The envelope includes an attack segment, a decay segment, a sustain segment and a release segment. After tracking the volume and pitch of a time slice, if the control point establishing the end point of the time slice is not the end of a release segment for a volume or pitch envelope, the start point for a next time slice is equated to the end point of the time slice. Also, the absolute values for the volume levels and the pitch level associated with the start point of the next time slice are equated to the absolute values for the volume levels and the pitch level associated with the end point of the time slice. The end point of the next time slice is set to the earliest occurring control point received as a result of the last call to the articulation generator module. The end point of the next time slice is then passed as a parameter in a call to an articulation generator module.

Similar to the previous calls, the articulation generator returns absolute values for the volume level and the pitch level for the end point of the time slice along with the next occurring control points for each component of the audio signal. The mix engine module is then called for tracking the volume and pitch levels of the next time slice.

In another embodiment, the audio signal, including a plurality of components with each component having at least one control point, can be divided into time slices by functionally merging each of the control points from each of the components onto a single time-line; and then identifying a time slice for each period of time located between each two adjacent control points on the time-line.

In the embodiments of the present invention that track the audio signal using linear units, the audio signal may be further divided by breaking each time slice into at least two smaller time slices if the length of the time slice exceeds a maximum length and the slope of at least one line extending between the volume levels associated with each control point and the pitch levels associated with each control point exceed a maximum slope associated with the length of the time slice.

In the embodiments of the present invention that track the audio signal using linear units, two or more adjacent time slices may be combined into a larger time slice if at least one of the time slices is not longer than a minimum length.

Thus, the present invention includes a system and a method for accurately tracking the pitch and volume of an audio signal while reducing the amount of processor time required to synthesize an audio signal.

These and other aspects, features, and advantages of the present invention will be more clearly understood and appreciated from a review of the following detailed description of the present invention and possible embodiments thereof, and by reference to the appended drawings and claims.

DETAILED DESCRIPTION

Figure 1:
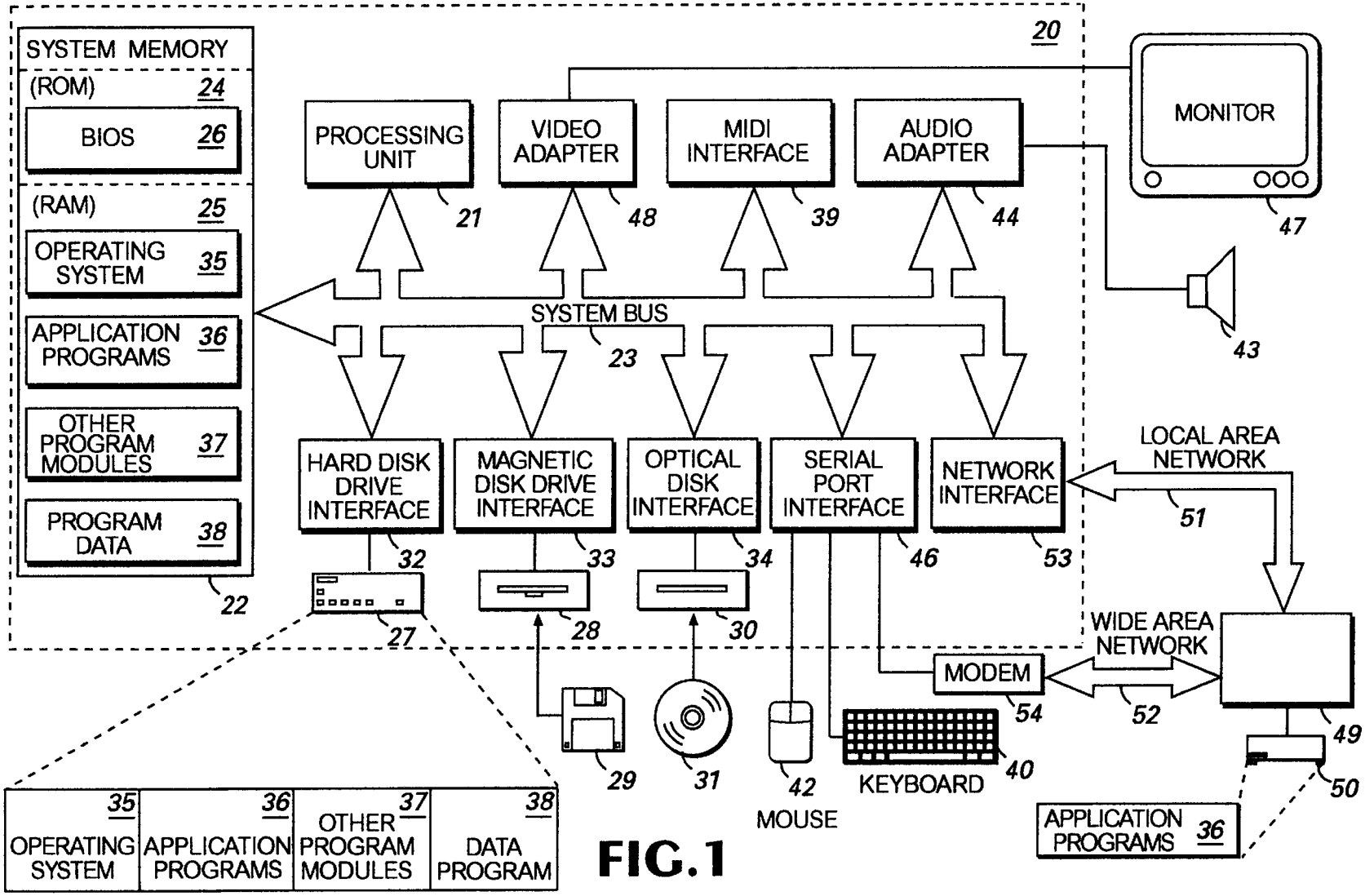
FIG. 1 is a system diagram that illustrates an exemplary environment suitable for implementing embodiments of the present invention.

The present invention is directed toward improving the performance of a software synthesizer by reducing the amount of processing time required to track the volume and pitch of an audio signal while minimizing any impact to the audio quality. In one embodiment, the invention may be incorporated into a software synthesizer. Alternatively, other embodiments of the invention may be incorporated into products using the Interactive Music Architecture ("IMA"). In addition, aspects of the present invention can be used in hardware based synthesizers or synthesizers using a combination of both hardware and software.

Briefly described, the present invention provides a system and a method to track parameters of an audio signal, such as volume and pitch, while reducing the amount of processing time by: (1) intelligently selecting points in time at which to adjust the parameters of an audio signal; and (2) intelligently tracking the changes in these parameters between these points. The invention optimizes the CPU performance of a software synthesizer by tracking audio signals at a lower resolution than the sample rate. The invention also operates to insure that, from a users perspective, the sound quality of the signal is not compromised.

A first aspect of the invention, "Dynamic Control Point Optimization", identifies "control points" in the audio signal at which to perform absolute adjustments to parameters of the audio signal. An absolute adjustment is defined as generating an output audio signal that is based on the combination of various inputs effecting a particular parameter of the audio signal (i.e., volume or pitch). The control points are used to divide the audio signal into multiple time slices. Thus, each time slice is defined by two adjacent control points, where one control point is the start point of the time slice and the other is the end point for the time slice. For each time slice, the processor of a software synthesizer is only required to generate absolute values for each of the parameters at the start point and the end point. The process of generating these absolute values is processor intensive, thus, utilizing this technique reduces the amount of processing time.

This aspect of the invention is "dynamic" because the location of the control points, and hence, the length of the time slices can be controlled to further minimize the amount of processing time required in synthesizing the audio signal. The selection of the time slices can ensure that the changes in the parameters over the duration of the time slice are linearly related or share some other simple, deterministic relationship. For example, during times of high signal activity when the parameters are changing at a high rate, the time slices can be shortened. Likewise, during times of low signal activity, the time slices can be lengthened. Advantageously, this solution reduces the average amount of processing time required to synthesize an audio signal while at t the same time, not compromising the sound quality of the audio signal. This is accomplished by sacrificing processing time for sound quality during periods of high signaling activity, and then limiting the processing time required during periods of low signaling activity.

A second aspect of the invention, termed "Optimized Resolution for Pitch and Volume Stepping", is concerned with estimating the changes in parameters of an audio signal at various points of time between the start point and the end point of a time slice. These estimated values are referred to as "time values", "discrete values", or "step values". Unlike absolute values, the time values can be easily generated by adding an offset to the current value of a parameter, at certain intervals ("step durations") between the control points. This aspect of the invention advantageously selects a step duration that limits the processing time without degrading the quality of the sound.

Referring now to the drawings, in which like numerals represent like elements through the several figures, these aspects of the present invention and the preferred operating environment will be described.

Exemplary Operating Environment

FIG. 1 is a system diagram that illustrates an exemplary environment suitable for implementing various embodiments of the present invention. FIG. 1 and the following discussion are intended to provide a brief, general description of a suitable computing environment in which the invention may be implemented. While the invention will be described in the general context of an application program that runs on an operating system in conjunction with a personal computer, those skilled in the art will recognize that the invention also may be implemented in combination with other program modules. Generally, program modules include routines, programs, components, data structures, etc. that perform particular tasks or implement particular abstract data types. Moreover, those skilled in the art will appreciate that the invention may be practiced with other computer system configurations, including hand-held devices, multiprocessor systems, microprocessor-based or programmable consumer electronics, minicomputers, mainframe computers, and the like. The invention may also be practiced in distributed computing environments where tasks are performed by remote processing devices that are linked through a communications network. In a distributed computing environment, program modules may be located in both local and remote memory storage devices.

The exemplary system illustrated in FIG. 1, includes a conventional personal computer 20, including a processing unit 21, system memory 22, and a system bus 23 that couples the system memory to the processing unit 21. The system memory 22 includes read only memory (ROM) 24 and random access memory (RAM) 25. The ROM 24 provides storage for a basic input/output system 26 (BIOS), containing the basic routines that help to transfer information between elements within the personal computer 20, such as during start-up. The personal computer 20 further includes a hard disk drive 27, a magnetic disk drive 28 for the purpose of reading from or writing to a removable disk 29, and an optical disk drive 30 for the purpose of reading a CD-ROM disk 31 or to read from or write to other optical media. The hard disk drive 27, magnetic disk drive 28, and optical disk drive 30 interface to the system bus 23 through a hard disk drive interface 32, a magnetic disk drive interface 33, and an optical drive interface 34, respectively. The drives and their associated computer-readable media provide nonvolatile storage for the personal computer 20. Although the description of computer-readable media above refers to a hard disk, a removable magnetic disk and a CD-ROM disk, it should be appreciated by those skilled in the art that other types of media which are readable by a computer, such as magnetic cassettes, flash memory cards, digital video disks, Bernoulli cartridges, and the like, may also be used in the exemplary operating environment.

A number of program modules may be stored in the drives 27–30 and RAM 25, including an operating system 35, one or more application programs 36, other program modules 37, and program data 38. A user may enter commands and information into the personal computer 20 through a keyboard 40 and pointing device, such as a mouse 42. Other input devices (not shown) may include a microphone, joystick, track ball, light pen, game pad, scanner, camera, or the like. These and other input devices are often connected to the processing unit 21 through a serial port interface 46 that is coupled to the system bus, but may be connected by other interfaces, such as a game port or a universal serial bus (USB). A computer monitor 47 or other type of display device is also connected to the system bus 23 via an interface, such as a video adapter 48. One or more speakers 43 are connected to the system bus via an interface, such as an audio adapter 44. In addition to the monitor and speakers, personal computers typically include other peripheral output devices (not shown), such a printers and plotters.

The personal computer 20 optionally includes a musical instrumentation digital interface ("MIDI") adapter 39 that provides a means for the PU 21 to control a variety of MIDI compatible devices (i.e., electronic keyboards, synthesizers, etc.) as well as receive MIDI events from the same. The MIDI adapter operates by receiving data over the system bus 23, formatting the data in accordance with the MIDI protocol, and transmitting the data over a MIDI bus 45. The equipment attached to the MIDI bus will detect the transmission of the MIDI formatted data and determine if the data is to be accepted and processed or ignored.

The personal computer 20 may operate in a networked environment using logical connections to one or more remote computers, such as a remote computer 49. The remote computer 49 may be a server, a router, a peer device or other common network node, and typically includes many or all of the elements described relative to the personal computer 20, although only a memory storage device 50 has been illustrated in FIG. 2. The logical connections depicted in FIG. 2 include a local area network (LAN) 51 and a wide area network (WAN) 52. These types of networking environments are commonplace in offices, enterprise-wide computer networks, intranets and the Internet.

When used in a LAN networking environment, the personal computer 20 is connected to the LAN 51 through a network interface 53. When used in a WAN networking environment, the personal computer 20 typically includes a modem 54 or other means for establishing communications over the WAN 52, such as the Internet. The modem 54, which may be internal or external, is connected to the system bus 23 via the serial port interface 46. In a networked environment, program modules depicted relative to the personal computer 20, or portions thereof, may be stored in the remote memory storage device. It will be appreciated that the network connections shown are exemplary and other means of establishing a communications link between the computers may be used.

Exemplary Structure

Figure 2:
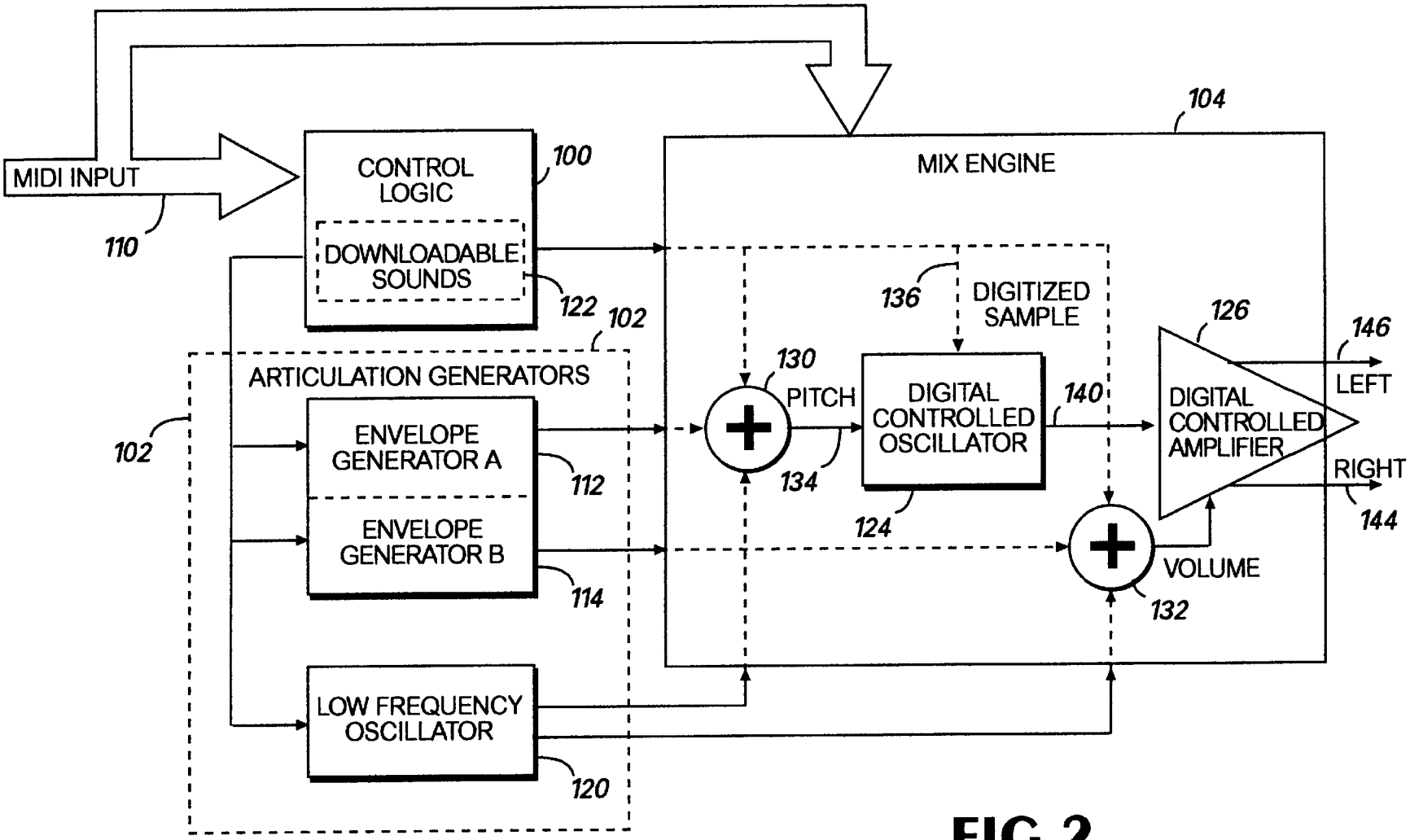
FIG. 2 is a block diagram that illustrates the general structure of a music synthesizer.

FIG. 2 is a block diagram that illustrates the general structure of an exemplary music synthesizer. Although the present invention may be embodied in a hardware or a software synthesizer, the benefit received from the various aspects of the invention are more applicable when embodied within a software synthesizer.

In general, a synthesizer operates by: (1) receiving input information that identifies the type of sound that the synthesizer is to produce; (2) receiving input information that identifies a note to play along with a variety of adjustments in the volume and the pitch of the note; and (3) combining the variety of volume and pitch information with a selected music sample to generate the desired audio signal. The music synthesizer illustrated in FIG. 2 includes three main components: Control Logic 100, Articulation Generators 102, and a Mix Engine 104.

The Control Logic 100 receives a variety of input information over interface 110 for defining the general type of sound that the synthesizer is to produce. This information includes program change commands, MIDI note on and off events, key press velocity, and sustain information. In response to receiving this information, the Control Logic 100 configures the Articulation Generators 102 and the Mix Engine 104. The Control Logic 100 configures the Articulation Generators by identifying the characteristics for the volume and pitch envelopes to be used by the Envelope Generator A 112 and Envelope Generator B 114. In addition, the Control Logic 100 identifies the frequency, shape and other characteristics of the signal to be generated by the Low Frequency Oscillator ("LFO") 120.

The instrument selection, along with the receipt of a MIDI note on event, enables the Control Logic 100 to configure the Mix Engine 104. This is accomplished by identifying a specific sample that is to be played by the Digital Controlled Oscillator 124. The sample may consists of a wave file defining the specific digitized sound to be fed into the Digital Controlled Oscillator 124, control parameters such as loop points to indicate the manner of loading the digitized sound into the Digital Controlled Oscillator 124, sample rates, etc.

Those skilled in the art will recognize that the use of Downloadable Sounds 122 are a standard mechanism that has been developed for providing this type of configuration information. Thus, the instrument selection results in selecting a particular Downloadable Sound 122 (e.g., piano, organ, electric guitar, etc.) that in turn, provides the configuration information for the Articulation Generator 102 and the Mix Engine 104.

The Articulation Generators 102 include two envelope generators 112 and 114, an LFO 120, and additional information received from the Control Logic 100. This particular configuration of Articulation Generator 102 is only provided as an exemplary structure for embodying the invention. Those skilled in the art will understand that additional LFO's as well as more or less envelope generators also can be used in other embodiments.

The LFO 120 generates a periodic wave form that is used to modulate the pitch and/or volume of the audio signal. Modulating the pitch of the audio signal with the periodic wave form from the LFO 120 may be used to add vibrato and tremolo to the audio signal. The particular shape, frequency, and other timing and characteristics of the periodic wave form is configured by the input of information received from the Control Logic 100.

In an exemplary embodiment, an Envelope Generator A is used to modulate the pitch of the audio signal while Envelope Generator B is used to modulate the volume of the audio signal. As an example, the Envelope Generator A 112 and the Envelope Generator B 114 may be based on a standard four segment envelope consisting of an attack, decay, sustain, and release segments. Other envelopes may also be used and the invention should not be limited to the selection of any particular envelope.

Figure 4:
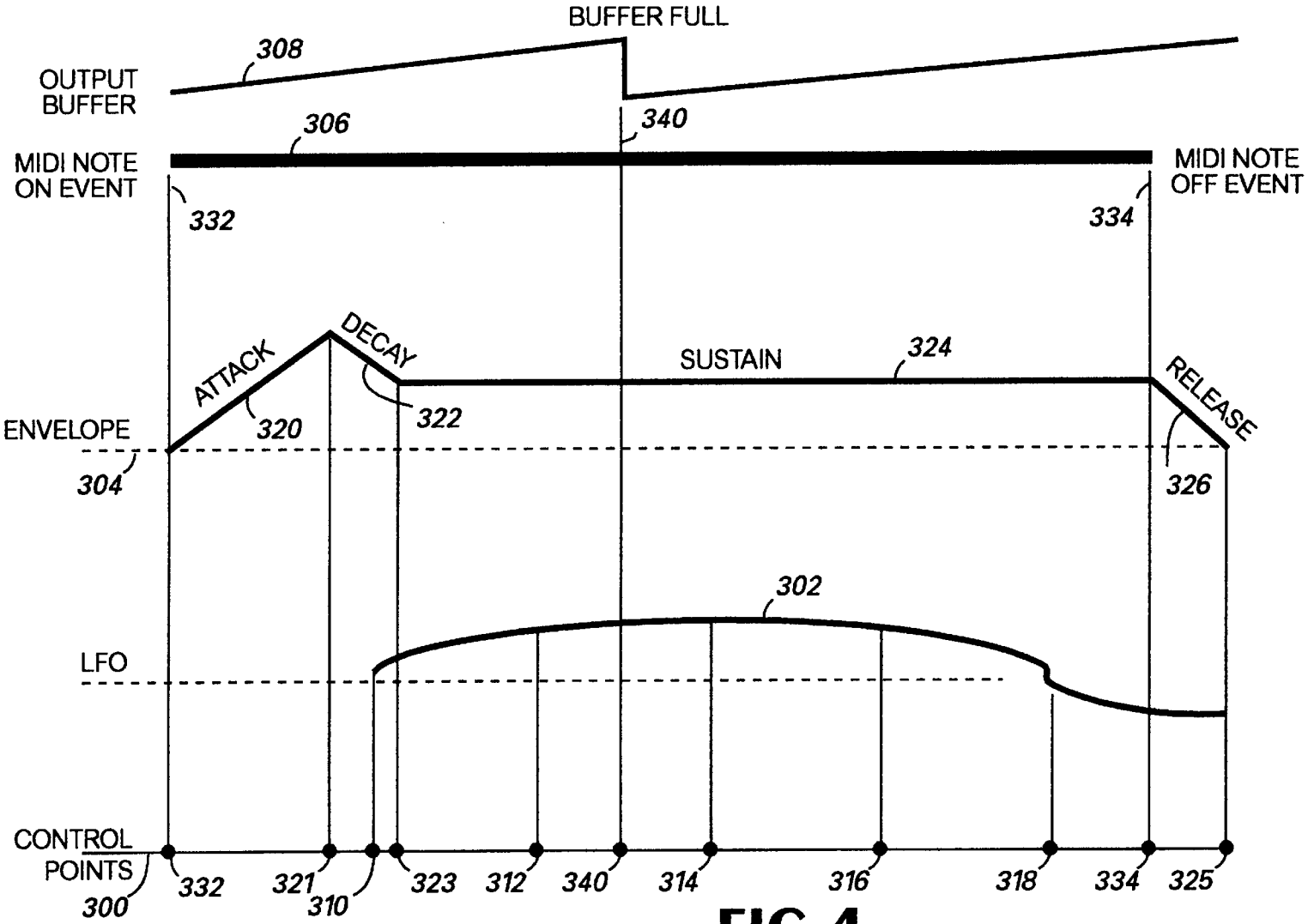
FIG. 4 is a timing diagram that illustrates one embodiment of the dynamic control point optimization aspect of the present invention.

FIG. 4 illustrates the operation of the standard four segment envelope 304. When a note begins, the attack segment 320 of the envelope is entered. During the attack segment 320, the level (i.e., volume or pitch) increases until it reaches a maximum level. At this point, the decay segment 322 is entered. In the decay segment 322, the level is gradually decreased to a steady level (i.e., the sustain level). In the sustain segment 324, the level is held constant or slightly decreases until the note is released. At this point, the release segment 326 is entered and the level decays out. The shape and timing characteristics of the envelope illustrated in FIG. 4 is only an example of a typical envelope. The actual characteristics of the envelope is based on the configuration information received by the Envelope Generator A 112 and the Envelope Generator B 114 from the Control Logic 100 illustrated in FIG. 2. Information such as the note being played or the velocity that the note has be pressed may also be used to modify the envelope.

Returning to FIG. 2, the Mix Engine 104 includes a pitch summation 130, a Digitally Controlled Oscillator 124, a volume summation 132, and a Digitally Controlled Amplifier 126.

The pitch summation 130 receives inputs from the Envelope Generator A 112, the LFO 120, the Control Logic 100, and information from the MIDI interface 110 such as the note being played, pitch bend events and information from a pitch wheel. All of this information is summed to generate a Pitch signal 134 that is input to the Digitally Controller Oscillator 124. In a hardware based synthesizer, this Pitch signal 134 may be a DC signal at a particular voltage or a digital signal having a particular bit duration. In a software based synthesizer, the Pitch signal 134 may be a multiple-bit pattern representing a particular value.

The Digitally Controlled Oscillator 124 receives two input signals, the Sample 136 and the Pitch signal 134. The Sample 136 is received from the Control Logic 100. The Sample 136 includes the digitized sound that was selected by the Control Logic 100 in response to the instrument selection and the note being played. The Pitch signal 134 is used to modulate the Sample 136 to deliver the final pitch for the note being played at the output 140 of the Digitally Controlled Oscillator 124.

The volume summation 132 receives inputs from the Envelope Generator B 114, the LFO 120, the Control Logic 100, and information from the MIDI interface 110 such as the volume setting, and MIDI expression events. All of this information is summed to generate a Volume Signal 142 that is input to the Digitally Controlled Amplifier 126. In a hardware based synthesizer, this Volume signal 132 may be a DC signal at a particular voltage or a digital signal having a particular bit duration. In a software based synthesizer, the Volume signal 132 may be a multiple-bit pattern representing a particular value.

The Digitally Controlled Amplifier. 126 receives three inputs, the Volume signal 126, the output 140 of the Digitally Controlled Oscillator 124, and panning information from the MIDI interface 110. The Digitally Controlled Amplifier 126 amplifies the output 140 from the Digitally Controlled Amplifier 126 based on the value of the Volume signal 142. The panning information from the MIDI interface 110 is used to divide the energy of the output audio signal between the left audio output 146 and the right audio output 144.

Dynamic Control Point Optimization

Figure 3:
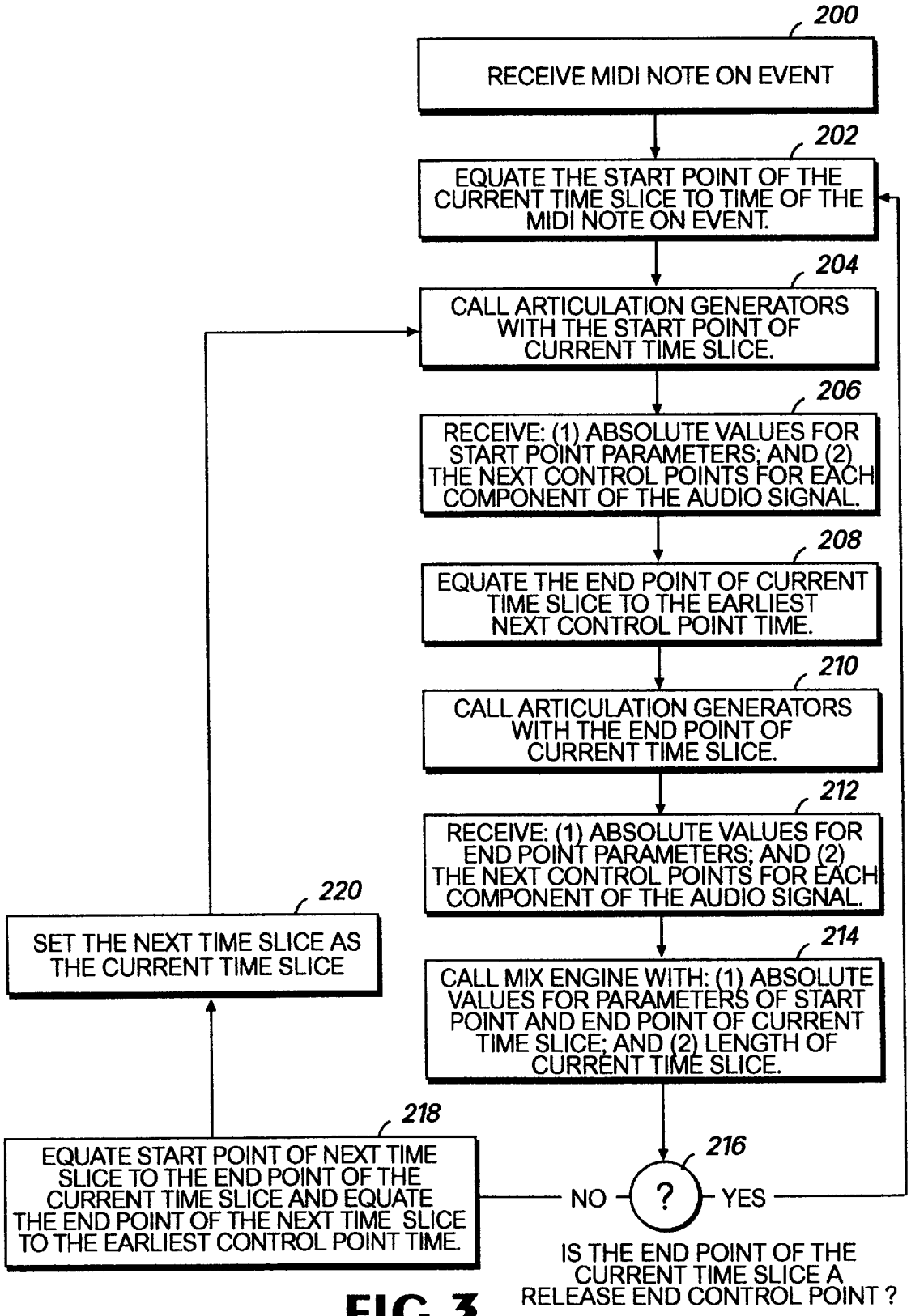
FIG. 3 is a flow diagram that illustrates one embodiment for performing the processes of the present invention.

FIG. 3 is a flow diagram that illustrates one embodiment for performing the processes of the present invention. In general, the invention focuses on the audio signal at the granularity of single notes. Thus, the reception of a MIDI note on event initiates the start of the flow diagram illustrated in FIG. 3. Likewise, the end of the release segment of the note, initiated by a MIDI note off event, defines the end of the flow diagram. The processes of receiving information to select an instrument at Control Logic 100 and configuring the Articulation Generators 102 and Mix Engine 104 are ancillary to the operation of the invention. In fact, the present invention is equally applicable within a system that uses hard-coded or static configurations for the articulation generators and/or the mix engine.

For discussion purposes, the present invention is described as operating in a main module that calls and passes parameters to function modules. Two such function modules may include an articulation generator module and a mix engine module. The software instructions, modules or processes performed by the invention may exist within one or more of the components of the synthesizer and the present invention should not be limited to any particular implementation. The present invention is described as including two aspects: (1) dynamic control point optimization, and (2) optimized resolution for pitch and volume stepping. Generally stated, the dynamic control point optimization aspect divides the audio signal into one or more time slices with absolute values for the pitch and volume being provided for the start point and end point of the time slice. The optimized resolution for pitch and volume stepping aspect of the invention defines the method that the output audio signal will be manipulated to track the volume and pitch levels between the start point and the end point of the time slice.

At step 200, a MIDI note on event is received by the main module. At step 202, the main module equates the start point of the first or current time slice to the time that the MIDI note on event was received. The main module then calls the articulation generator module at step 204 and passes the start point of the first or current time slice to this module.

At step 206, in response to calling the articulation generator module with the start point of the current time slice, the main module receives absolute values for the volume and pitch levels of the audio signal associated with this particular time. These absolute values are analogous to the values of the Pitch signal 134 input to the Digitally Controlled Oscillator 124 and the Volume signal 142 input to the Digitally Controller Amplifier 126 FIG. 2. In addition, the main module receives the points in time that one or more events (i.e., control points) will occur. At step 208, the main module equates the end point of the first or current time slice to the earliest occurring control point received from the articulation module.

The invention anticipates that many functional components can be used in determining control points. The following list provides examples of some of these functional components, however, the present invention is not limited to only these examples.

(1) MIDI note on and note off events. Upon detection of a note being pressed or released, control points are generated.

(2) Volume envelope. Although any multistage envelope analysis can be used, the invention uses the standard ADSR (attack, decay, sustain, and release) envelope design. The control points identified by the volume envelope are the start of the decay segment, the start of the sustain segment, and the end of the release segment. The start of the attack segment is synonymous with the MIDI Note On event and the start of the release segment is synonymous with the MIDI Note Off event.

(3) Pitch envelope. Similar to the volume envelope, the pitch envelope is based on the standard ADSR envelope design.

(4) Low Frequency Oscillator. The oscillator starts with an initial delay followed by a sine wave oscillating at frequency F. The control points identified by the LFO wave form include: the start of delay, which is synonymous with the Note On, end of delay, and 8 samples taken over one period of the sine wave (i.e., 8*F samples per second).

(5) MIDI Controllers. The occurrence of various MIDI events in the audio stream may be identified as control points. For example, the events of note on, note off, pitch bend and expression result in generating control points.

(6) Output Buffer. The synthesized audio signal may be stored in digital form in an output buffer. Each time the output buffer is filled, a control point is generated. Thus, the distance between the buffer control points is a function of the size of the buffer.

(7) External events such as volume changes can also be used for generating control points.

FIG. 4 is a timing diagram that illustrates an example of the operation of the dynamic control point optimization aspect of the present invention. In this example, four functional components provide the basis for control point determination. A portion of an output signal 302 from an LFO is illustrated with control points being defined at ⅛ wave length intervals 310, 312, 314, 316 and 318. A general four segment envelope 304 is illustrated with control points being defined at the start of the attack segment 320, the transition from the attack segment 320 to the decay segment 322, the transition from the decay segment 322 to the sustain segment 324, the transition from the sustain segment 324 to the release segment 326, and the end of the release segment 326. These control points are respectively 332, 321, 323, 334, and 325.

The duration of a note 330 is illustrated as the time between a MIDI note on event and a MIDI note off event. Note that the MIDI note on event defines a control point 332 that is synonymous with the start of the attack segment 320 of the envelope 304 (control point 332) and the MIDI note off event defines a control point 334 that is synonymous with the start of the release segment 326 of the envelope 304 (control point 334). Finally, the status of an output buffer 308 is illustrated with a control point being defined at the point that the output buffer is full 340.

Referring to FIG. 4, an example illustrating the operation of steps 200 through 206 in FIG. 3 is provided. At step 202, the start point of the first time slice is equated to the control point defined by the MIDI note on event 332. In response to calling the articulation generator module the main module will receive the following control points:

(a) the first interval of the LFO signal 310;

(b) the transition between the attack segment 320 and the decay segment 322 of the envelope 304 (control point 321);

(c) the control point defined by the MIDI note off 334 (if this event has actually occurred); and (d) the control point 340 defined by the output buffer 308 being full.

At step 208, the main module equates the end of the first or current time slice to the earliest occurring control point received from the articulation generator module in step 206. For the illustrated example, the main module would select the end of the attack segment 320 of the envelope 304 as the end point of the first or current time slice (control point 321).

At step 210, the main module calls the articulation generator module again, passing the end point of the first or current time slice. At step 212, in response to calling the articulation generator, the main module receives absolute values for the volume and pitch levels of the audio signal associated with the time of the end point. In addition, the main module receives the points in time, after the end point, that one or more control points occur.

At this point, the first or current time slice is completely defined with a start point, an end point, and absolute values for the volume and pitch of the audio signal associated with the start point and the end point.

At step 214, the main module calls the mix engine module and passes (1) the absolute values for the volume and pitch levels for the start point and end point of the time slice, and (2) the length of the first or current time slice. The detailed operation of the mix engine module will be discussed below.

At step 216, if the end point of the current time slice is anything other than a control point defined by the end of the release segment of an envelope, then processing continues at step 218. At step 218, the start point of the next time slice is equated to the end point of the current time slice and the end point of the next time slice is equated to the time of the earliest occurring control point returned from the articulation generator module in step 212. At step 220, the next time slice becomes the current time slice and processing continues at step 204.

Processing continues through this loop until it is determined (at step 216) that the end point of the current time slice is defined by the end of a release segment of an envelope. At this point, processing returns to step 200 pending the occurrence of the next MIDI note on event.

The mix engine module performs the optimized resolution for pitch and volume stepping aspect of the invention. In performing this, the mix engine module uses the absolute values for the volume and pitch levels associated with the start point and the end point of a time slice to determine time values for the volume and pitch levels at step points or interim points between the start point and the end point. Thus, the volume and pitch levels can be gradually ramped from the value at the start point of the time slice to the value at the end point of the time slice. A key ingredient of this aspect of the invention involves receiving the absolute values for the volume and pitch levels at the start point and end point in perceptual units (i.e., decibels for volume and semitones for pitch), and then selecting the step sizes between the start point and the end point based on a function of these perceptual units.

Another key ingredient of this aspect of the invention is the exploitation of the linear characteristic of the time slice. The time slices are selected so that the volume level and the pitch level, over the duration of the time slice, are substantially linear when expressed in perceptual units. For each time slice, a step size is defined for distributing the difference between the levels for the start point and the end point over the duration of the time slice. The step size includes two components: a step duration (i.e., length in time of the step) and a step delta. The step duration is inversely proportional to the rate of change in the magnitude of a parameter between the start point and the end point of the time slice. In one embodiment, the step duration is selected to be the number of samples required for the magnitude of the parameter (i.e., volume or pitch) to change a specific number of perceptual units. In another embodiment, the step duration is selected to be the number of samples required for the magnitude of the parameter (i.e., volume or pitch) to change a predetermined amount that is substantially indiscernible by human ears. Due to the substantially linear characteristic of the volume and pitch levels over the duration of the time slice, the selection of the step duration based on samples/level change allows the volume and pitch levels to be ramped over the duration of the time slice in a perceptually consistent manner.

Figure 5:
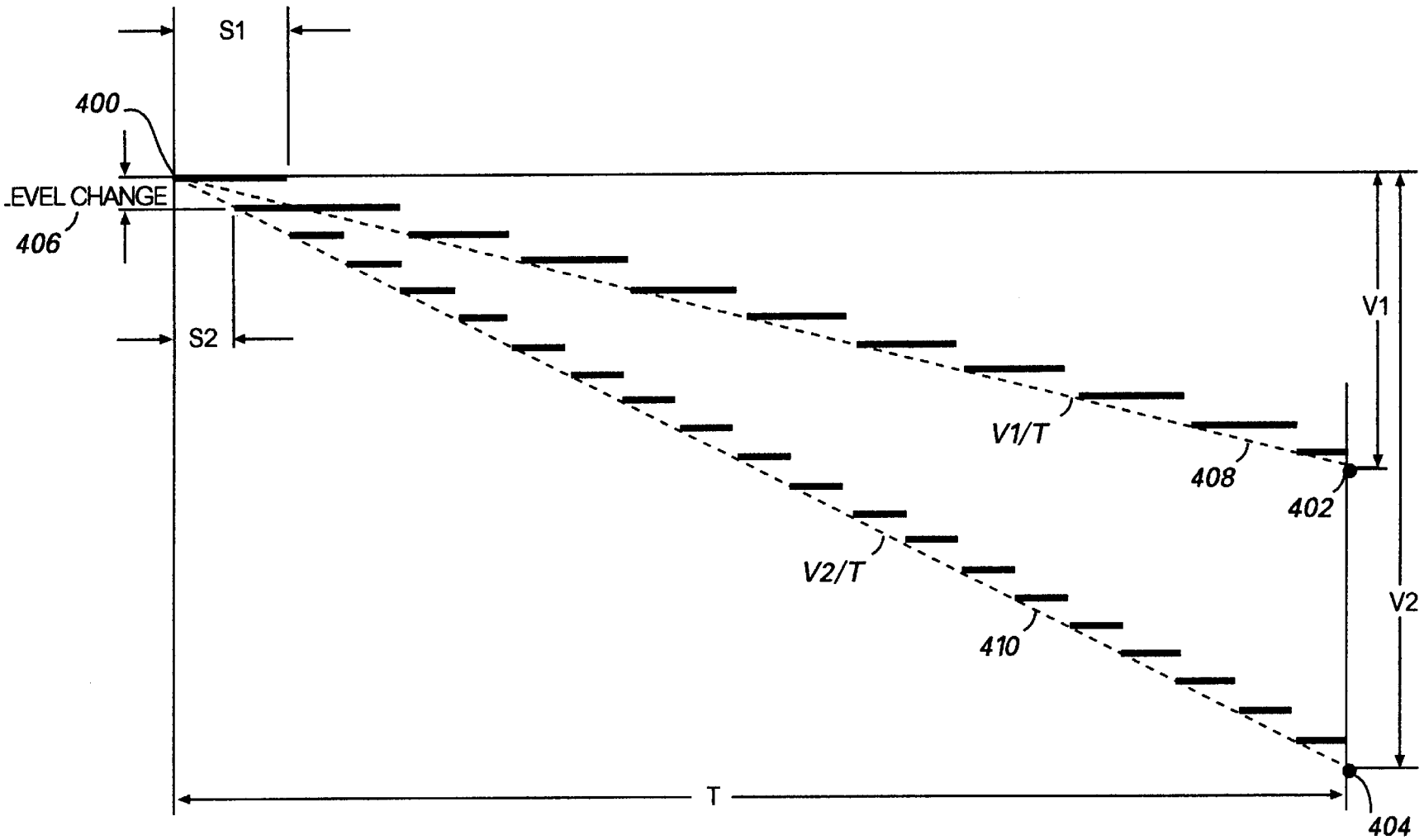
FIG. 5 is a timing diagram that illustrates the relationship between the rate of change of a parameter of an audio signal and the length of the step duration.

FIG. 5 illustrates the effect that the rate of change of a parameter over the duration of a time slice has on the step duration. Two sets of start points and end points of a time slice having a duration T are illustrated. The difference in the magnitude of start point 500 and end point 502 is V1 and defines a rate of change of V1/T. The difference in the magnitude of start point 500 and end point 504 is V2 and defines a rate of change of V2/T. A level change 506 is also illustrated. Typically, the level change is selected as the maximum amount that a particular parameter can change without being discernible by human ears. For a volume parameter, this level change is on the order of 0.01 decibels (dB). For a pitch parameter, this level change is on the order of 0.005 semitones (s/t). Connecting the start point 500 and the end point 502 by an imaginary line 508, the step duration for a level change 506 in the magnitude of the imaginary line 508 is S1. Likewise, connecting the start point 500 and the end point 504 by an imaginary line 510, the step duration for a level change 506 is S2. If V2 is equal to 2*V1, then the rate of change V2/T is equal to 2*V1/T. Thus, the step duration S2 is equal to S1/2 illustrating that the step duration is inversely proportional to the rate of change between the start point and the end point.

FIG. 5 also illustrates that the difference in the magnitude between the start point and the end point of a time slice can be uniformly distributed in step duration intervals over the duration of the time slice.

Another key ingredient of this aspect of the invention is the use of perceptual units to determine the step size, but the use of linear units in ramping the levels of the parameters between the start point and the end point of the time slice. Ideally, the most accurate method to track the volume and pitch between the start point and the end point of the time slice is to add an offset in perceptual units to the volume or pitch level (also in perceptual units), then convert the value into linear units for controlling the digitally controlled oscillator or digitally controlled amplifier. However, the process of converting the volume and pitch levels from perceptual units into linear units is processor intensive. Thus, once the step size is determined, the volume and pitch are tracked by converting the difference between the levels at the start point and the end point of a time slice into linear units. Then, a linear offset is cumulatively added such that at the last step, the offset is equal to the difference between the start point and the end point. This method reduces the processing time required to track the volume and pitch levels over the duration of the time slice by eliminating the step of converting from perceptual units into linear units at each step.

Although tracking the levels in linear units is not as accurate as tracking in perceptual units, the length of the time slices are such that perceptually, no degradation can be discerned in the sound quality. The invention also provides a method to handle situations that may result in degrading the sound quality of the audio signal. For instance, the length of the time slices may be limited to ensure that there is no discernible degradation in the sound quality.

Aspects of the present invention are also applicable in systems that track the levels of an audio signal in perceptual units. In a system such as this, the step duration can be increased to a maximum value or restricted to a minimum value. This will allow more time for converting the perceptual units into linear units between each step.

Optimized Resolution for Pitch and Volume Stepping

Figure 6:
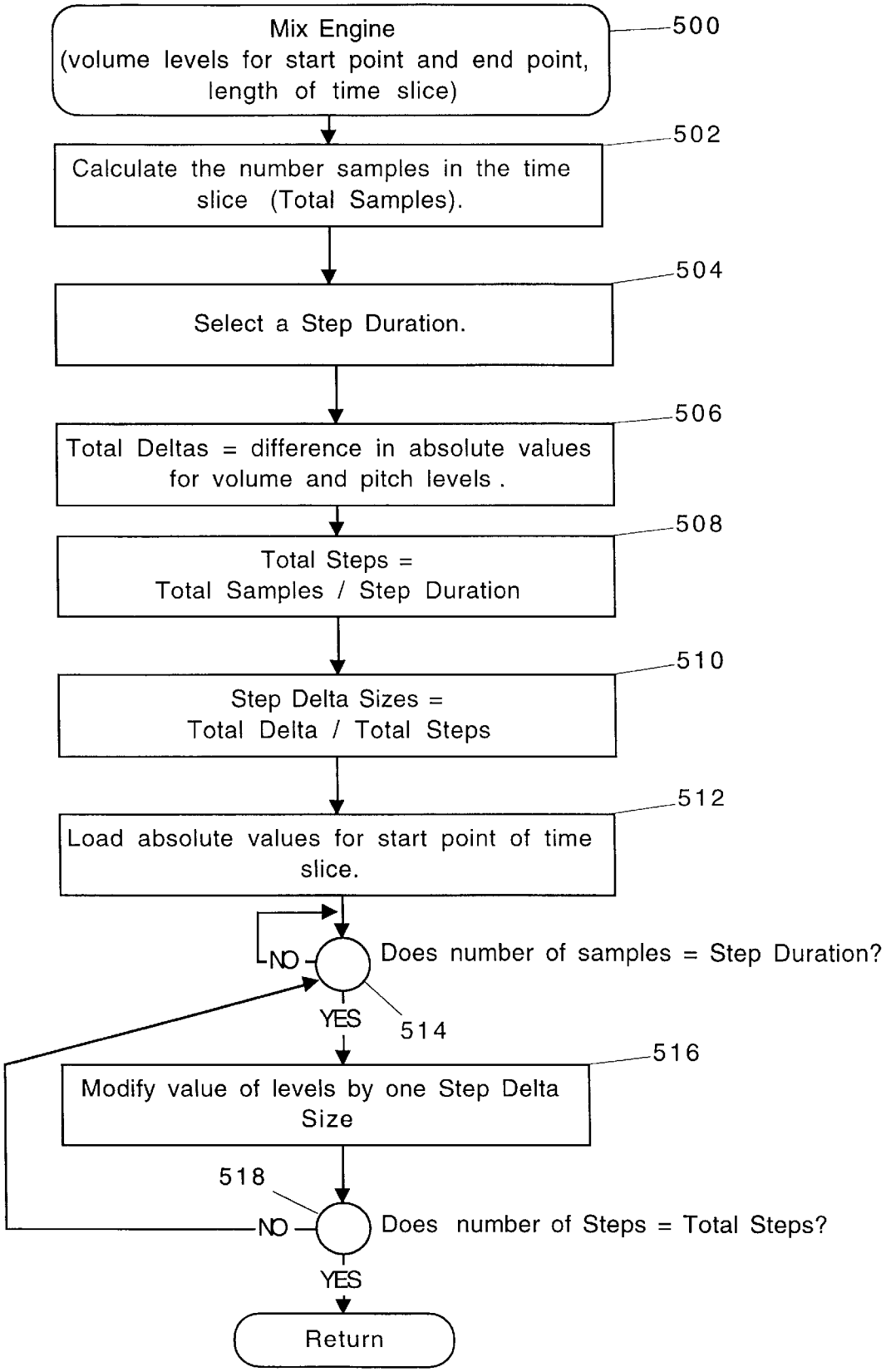
FIG. 6 is a flow diagram that illustrates, one embodiment of the processes involved in performing the optimized resolution for pitch and volume stepping aspect of the present invention.

FIG. 6 is a flow diagram that illustrates one embodiment of the processes involved in performing the optimized resolution for pitch and volume stepping aspect of the present invention by an exemplary mix engine module. At step 500, the mix engine module is passed absolute values for the start point and end point of the time slice and the length of the time slice. At step 502, the total number of samples that occur over the duration of the time slice (Total Samples) is determined. Thus, based on a sample rate of X samples/second, the total number of samples is calculated by dividing the length of the time slice by the sample rate. As previously described, the sample rate may be provided in response to the instrumentation selection.

Figure 7:
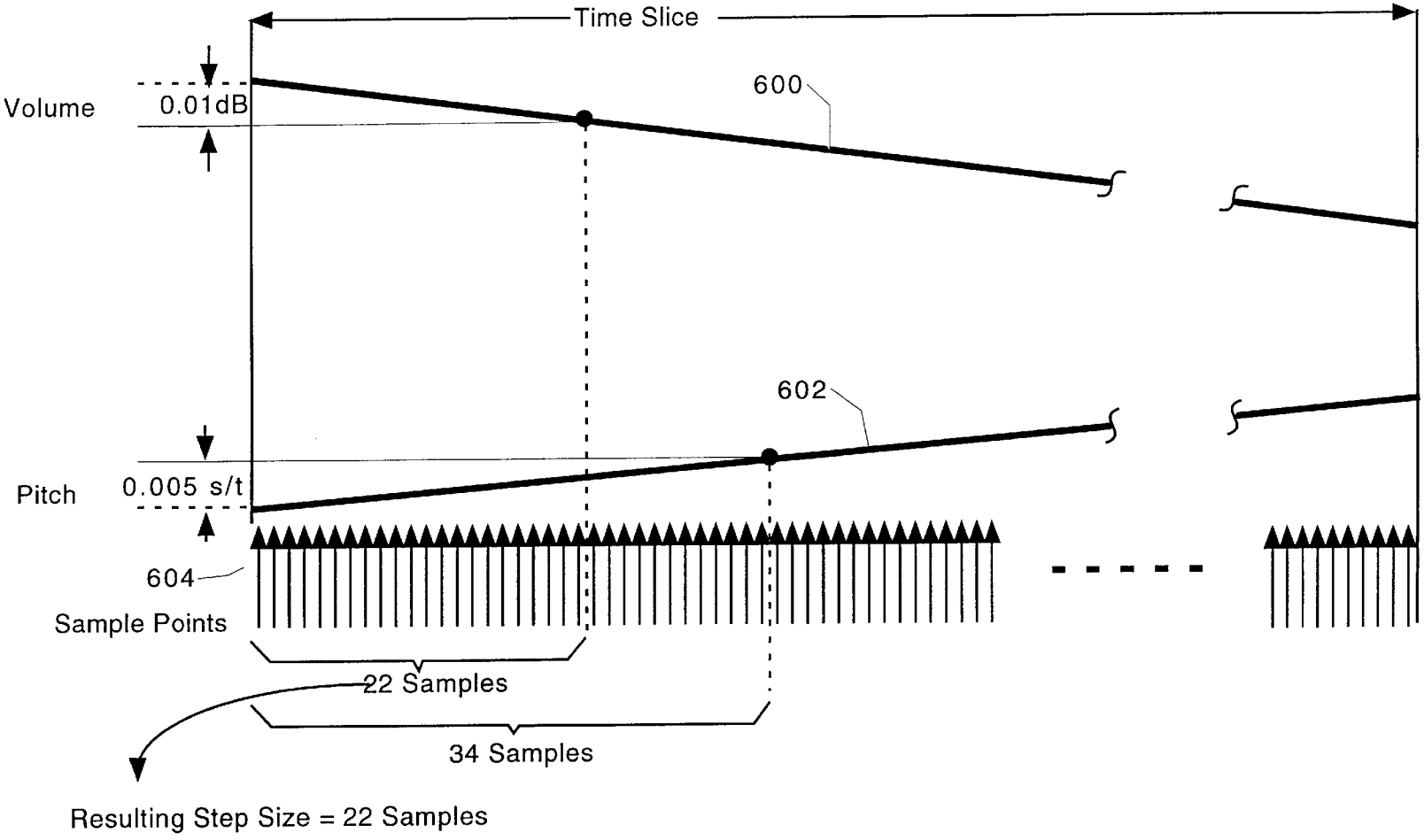
FIG. 7 is a timing diagram that illustrates one embodiment of the optimized resolution for pitch and volume stepping aspects of the present invention.

At step 504, a Step Duration is selected. The Step Duration, expressed in units of samples, identifies the number of samples that should occur between each adjustment in the volume or pitch levels. FIG. 7 is a timing diagram that provides an example illustrating the operation of the optimized resolution for pitch and volume stepping aspects of the present invention. The level changes for the volume level 600 and the pitch level 602 are shown over the duration of a time slice. Sample points 604 are also illustrated over the duration of the time slice. To determine the step duration, the number of samples required for the volume level to change 0.01 dB and the pitch level to change 0.005s/t are determined. In this example, 22 samples are illustrated as occurring during the volume level change and 34 samples during the pitch level change. In practice, the number of samples may be substantially larger than illustrated in the example. The step duration is then selected to be the smaller of these two values, hence, 22 samples. The values of 0.01 dB and 0.005s/t are optimal values and represent a maximum amount of change in the volume and pitch respectively, that is not discernible by human ears. The present invention is not limited to only these values. Smaller values can be chosen at the expense of processor time and larger values can be chosen at the expense of sound quality.

Returning to FIG. 6, at step 506 a Total Delta is calculated for each of the parameters (i.e., volume and pitch). The Total Delta represents the change in magnitude of a parameter over the duration of a time slice. In an exemplary embodiment, this value is then converted from perceptual units into linear units. In an alternative embodiment, the Total Delta is not converted and is maintained in perceptual units.

At step 508, the total number of steps occurring over the duration of the time slice (Total Steps) is determined. This is accomplished by dividing Total Samples by the Step Duration.

At step 510, a Step Delta for each of the parameters is determined by dividing the appropriate Total Delta by the Total Steps.

At step 512, the actual tracking of the volume and pitch levels begin. Initially, the absolute values for the volume and pitch levels of the start point (in linear units) are used as inputs to a digitally controlled amplifier and digitally controlled oscillator respectively. At step 514, a loop is entered that simply counts the samples over time until the next step point is reached (i.e., a Step Duration number of samples occur). Once a step point is reached, processing continues at step 516.

At step 516, the inputs to the digitally controlled amplifier and the digitally controlled oscillator are increased or decreased by the appropriate Step Delta. At step 518, if the end of the time slice has not been reached (i.e., the number of steps is less than the Total Steps) then processing continues at step 514. This loop including steps 514, 516 and 518 continues until the end of the time slice is reached. During this loop, the only overhead required is counting the number of samples and then adding an offset to the inputs for the digitally controlled amplifier and the digitally controlled oscillator. Once the end of the time slice is reached (i.e., the number of steps equals the Total Steps), the process is completed.

Conclusion

From the foregoing description, it will be appreciated that the present invention provides a system and a method for tracking parameters of an audio signal that reduces the amount of processing time without causing any discernible degradation in the sound quality of the audio signal. Data representing an audio signal is intelligently divided into multiple time slices and the parameters of the audio signal are tracked over the duration of the time slice. The time slices are selected so that the actual characteristic of the parameters over the duration of the time slice can be easily approximated by performing simple, nonprocessor intensive steps. The characteristics of various components of an audio signal such as a volume envelope, pitch envelope, low frequency oscillator, MIDI commands controlling the audio signal, and various other inputs are used to identify control points. Adjacent control points are then selected as the start point and end point of a time slice. Absolute values for the start point and the end point of the time slice are used to determine a step duration and a step delta. The parameters of the audio signal are tracked by using the absolute values for the start point of the time slice to generate initial control signals for the audio signal at the start point of the time slice. Then, the control signals are modified by the step delta at every step duration to the end point of the time slice. The present invention can be embodied within a software synthesizer The present invention may be conveniently implemented in one or more program modules. No particular programming language has been indicated for carrying out the various tasks described above because it is considered that the operation, steps, and procedures described in the specification and illustrated in the accompanying drawings are sufficiently disclosed to permit one of ordinary skill in the art to practice the instant invention. Moreover, in view of the many different types of computers and program modules that can be used to practice the instant invention, it is not practical to provide a representative example of a computer program that would be applicable to these many different systems. Each user of a particular computer would be aware of the language and tools which are more useful for that user's needs and purposes to implement the instant invention.

The present invention has been described in relation to particular embodiments which are intended in all respects to be illustrative rather than restrictive. Those skilled in the art will understand that the principles of the present invention may be applied to, and embodied in, various program modules for execution on differing types of computers regardless of the application.

Alternative embodiments will become apparent to those skilled in the art to which the present invention pertains without departing from its spirit and scope. Accordingly, the scope of the present invention is described by the appended claims and supported by the foregoing description.

I claim:

1. An audio signal synthesis method for tracking a signal parameter over the duration of a time slice of an audio signal, comprising the steps of:

receiving a start point and an end point defining the boundaries of a time slice and absolute values representing the magnitude of the signal parameter at the start point and the end point;

determining a step duration, the step duration being inversely proportional to the rate that the magnitude of the signal parameter changes between the start point and the end point; and providing a stepped representation of the signaling parameter that changes in magnitude at step duration intervals, from the magnitude at the start point to the magnitude at the end point.

2. The method of claim 1, wherein the signal parameter is a volume level for the audio signal, and the step of determining a step duration comprises, based on the slope of a line extending from the magnitude of the volume level at the start point to magnitude of the volume level at the end point of the time slice, equating the step duration to the amount of time required for the volume level to change a predetermined indiscernible amount.

3. The method of claim 1, wherein the signal parameter is a pitch level for the audio signal, and the step of determining a step duration comprises, based on the slope of a line extending from the magnitude of the pitch level at the start point to magnitude of the pitch level at the end point of the time slice, equating the step duration to the amount of time required for the pitch level to change a predetermined indiscernible amount.

4. An audio signal synthesis method for tracking a plurality of signal parameters over the duration of a time slice of an audio signal, comprising the steps of:

receiving a start point and an end point defining the boundaries of a time slice and absolute values representing the magnitude of each of the plurality of signal parameters at the start point and the end point of the time slice;

determining a step duration, the step duration being inversely proportional to the maximum rate of change in the magnitude of each of the plurality of signal parameters between the start point and the end point; and providing a stepped representation of each of the signal parameters that changes in magnitude at step duration intervals, from the respective magnitude at the start point to the magnitude at the end point.

5. The method of claim 4, wherein the plurality of signal parameters include a volume level and a pitch level, and the step of determining a step duration comprises the steps of:

determining the slope of a volume line extending from the magnitude of the volume level at the start point to magnitude of the volume level at the end point of the time slice;

determining the slope of a pitch line extending from the magnitude of the pitch level at the start point to the magnitude of the pitch level at the end point of the time slice; and equating the step duration to the lesser amount of time required, based on the slopes of the volume line and the pitch line, for the volume level to change a first predetermined indiscernible amount and the pitch level to change a second predetermined amount.

6. The method of claim 4, wherein the plurality of signal parameters include a volume level and a pitch level, the audio signal has a sample rate, and the step of determining a step duration comprises the steps of:

determining a first number of samples that occur at the sample rate, during a period of time required for the volume level to change a first predetermined amount along a line extending from the magnitude of volume at the start point to the magnitude of the volume at the end point;

determining a second number of samples that occur at the sample rate, during a period of time required for the pitch level to change a second predetermined amount along a line extending from the magnitude of the pitch at the start point to the magnitude of the pitch at the end point; and equating the step duration to the lesser number of samples of the first number of samples and the second number of samples.

7. The method of claim 6, further comprising after the step of determining a step duration, the step of determining a step delta for each of the plurality of signal parameters by dividing the difference in the magnitudes of each of the plurality of parameters at the start point and the end point of the time slice by the number of steps having the step duration that exist over the duration of the time slice.

8. The method of claim 7, wherein the step of providing a stepped representation of each of the plurality of signal parameters comprises the steps of, for each particular parameter of the plurality of parameters:

setting the magnitude of the first step of an output signal representing a particular parameter, to the received absolute value of the particular signal parameter at the start point of the time slice, the first step having the step duration; and setting the magnitude of each subsequent step of an output signal representing the particular parameter to the magnitude of the previous step plus the step delta duration, each subsequent step having the step duration.

9. The method of claim 8, wherein the magnitudes of each of the plurality of parameters are provided in perceptual units and the first and second predetermined amounts are selected based on the amount of time required to convert the magnitudes at each step of the stepped representation from perceptual units into linear units.

10. The method of claim 8, wherein the magnitudes the start point and the end point of each of the plurality of parameters are provided in perceptual units and the first predetermined indiscernible amount is about 0.01 decibels and the second predetermined indiscernible amount is about 0.005 semitones.

11. A computer-readable medium having computer-executable instructions for performing the steps recited in claim 8.

12. The method of claim 6, wherein the absolute values for the signal parameters at the start point and the end point are provided in perceptual units, further comprising after the step of determining a step duration, the steps of:

converting the difference in the magnitudes between the start point and the end point of each of the plurality of parameters from perceptual units into linear units; and equating a step delta for each of the plurality of parameters to the converted difference divided by the number of steps having the step duration that exist over the duration of the time slice.

13. The method of claim 12, wherein the step of providing a stepped representation of each of the plurality of parameters comprises the steps of, for each particular signal parameter:

setting the magnitude of a first step duration of an output signal representing the particular parameter to the received absolute value of the particular parameter at the start point of the time slice converted into linear units; and setting the magnitude of each subsequent step duration of the output signal representing the particular parameter to the magnitude of the previous step duration plus the step delta converted into linear units.

14. The method of claim 12, wherein the first predetermined amount is about 0.01 decibels and the second predetermined amount is about 0.005 semitones.

15. A computer-readable medium having computer executable instructions for performing the steps recited in claim 14.

16. The method of claim 6, wherein the absolute values at the start point and the end point for each of the plurality of parameters are provided in perceptual units, further comprising after the step of determining a step duration, the steps of:

if the length of the time slice is less than a maximum length, converting the difference in the magnitudes of the absolute values between the start point and the end point of each of the plurality of parameters from perceptual units into linear units; and equating a step delta for each of the plurality of parameters to the converted difference divided by the number of steps having the step duration that exist over the duration of the time slice.

17. An audio signal synthesis system for tracking the volume level and the pitch level of an audio signal, comprising:

a processing unit;

a memory storage device;

a data source for providing digital data that represents various aspects of the audio signal, the data including samples at a sample rate of the volume level and the pitch level of the audio signal;

a program module, stored in the memory storage device for providing instructions to the processing unit;

the processing unit, responsive to the instructions of the program module, being operative to:

receive from the data source, absolute values for the volume level and the pitch level for a start point and an end point, the start point and the end point defining the boundaries of a time slice of the audio signal, the absolute values being in perceptual units;

define a step duration, the step duration being inversely proportional to one of two rates of change including the rate of change of the volume level and the rate of change of the pitch level over the duration of the time slice;

equate a volume total delta to the difference between the absolute value of the volume level at the start point and the end point;

equate a pitch total delta to the difference between the absolute value of the pitch level at the start point and the end point; and distribute uniformly the volume total delta and the pitch total delta in accordance with the step duration to produce a stepped signal representation that traverses the volume total delta and the pitch total delta over the duration of the time slice.

18. The system of claim 17, wherein the volume level includes a left volume level and a right volume level and the processing unit is operative to identify a step duration by:

determining the number of samples required for the value of the left volume level to change a first predetermined indiscernible amount;

determining the number of samples required for the value of the right volume level to change the first predetermined indiscernible amount;

determining the number of samples required for the value of the pitch level to change a second predetermined indiscernible amount; and equating the step duration to the minimum number of samples determined for each of the levels.

19. The system of claim 17, wherein the processing unit is operative to distribute the volume total delta and the pitch total delta by:

identifying the total number of samples between the start point and the end point of the time slice;

equating the total number of steps to the total number of samples divided by the step duration;

equating a volume step delta to the volume total delta divided by the total number of steps;

equating a pitch step delta to the pitch total delta divided by the total number of steps;

equating the value of a first step of the volume level to the absolute value of the volume level at the start point and equating the value of each subsequent step of the volume level to the sum of the value of the previous step and the volume step delta; and equating the value of a first step of the pitch level to the absolute value of the pitch level at the start point and equating the value of each subsequent step of the pitch level to the sum of the value of the previous step and the pitch step delta.

20. An audio signal synthesis method for dividing an audio signal into time slices, the audio signal including a plurality of components including a volume component and a pitch component, with each component having at least one control point, comprising the steps of functionally merging each of the control points from each of the components onto a single time-line; and identifying a time slice for each period of time located between each two adjacent control points on the time-line.

21. The method of claim 20, wherein each time slice has a length that is defined as the difference between the time associated with the control points bounding the time slice, and each control point has an associated volume level and a pitch level, further comprising the step of breaking each time slice into at least two smaller time slices if the length of the time slice exceeds a maximum length and the slope of at least one line extending between the volume levels associated with each control point and the pitch levels associated with each control point exceed a maximum slope associated with the length of the time slice.

22. The method of claim 20, wherein one component of the audio signal includes a plurality of MIDI events and the control points associated with this component include the note on and the note off MIDI events.

23. The method of claim 22, wherein one component of the audio signal is a volume envelope and the control points associated with the volume envelope include:

the end of the attack segment of the volume envelope;

the end of the decay segment of the volume envelope; and the end of the release segment of the volume envelope.

24. The method of claim 23, wherein one component of the audio signal is a pitch envelope and the control points associated with the pitch envelope include:

the end of the attack segment of the pitch envelope;

the end of the decay segment of the pitch envelope; and the end of the release segment of the pitch envelope.

25. The method of claim 24, wherein one component of the audio signal is a sine wave generated by a low frequency oscillator and the control points associated with the sine wave include intervals of the sine wave ranging from ¼th to 1/16th wavelengths.

26. The method of claim 25, wherein one component of the audio signal includes receiving status signals from external sources and the control point for this component includes the occurrence of a buffer full signal.

27. A computer-readable medium having computer executable instructions for performing the steps recited in claim 26.

28. A computer-readable medium having computer executable instructions for performing the steps recited in claim 20.

29. An audio signal synthesis system for providing a time slice of an audio signal to a requesting system, comprising:

a processing unit;

a memory storage device;

a data source for providing digital data that represents various aspects of the audio signal including a plurality of components of the audio signal including a volume component and a pitch component, with each component having at least one control point;

a program module, stored in the memory storage device for providing instructions to the processing unit;

the processing unit, responsive to the instructions of the program module, being operative to:

receive a request for the time slice, the request including a control point that identifies the start point of the time slice; and equate an end point for the time slice to the time of the next control point of each of the control points in the plurality of components, that occurs after the start time.

30. The system of claim 29, wherein one of the plurality of components includes a plurality of MIDI events and the control points associated with this component include the MIDI note on event, MIDI note off event, pitch bend event, and expression change event.

31. The system of claim 29, wherein one of the plurality of components includes a four segment volume envelope having an attack segment, decay segment, sustain segment and release segment and the control points associated with the volume envelope include:

the end of the attack segment;

the end of the decay segment; and the end of the release segment.

32. The system of claim 29, wherein one of the plurality of components includes a four segment pitch envelope having an attack segment, decay segment, sustain segment and release segment and the control points associated with the pitch envelope include:

the end of the attack segment;

the end of the decay segment; and the end of the release segment.

33. The system of claim 29, wherein one of the plurality of components is a sine wave generated by a low frequency oscillator and the control points associated with the sine wave include intervals of the sine wave at a range of ¼th to 1/16th wavelengths.

34. The system of claim 29, wherein one of the plurality of components includes receiving status signals from at least one external source and the control points associated with this component include the occurrence of a buffer full signal.

35. A method for synthesizing an audio signal from digital information representing the audio signal, the digital information including the identity of a plurality of control points, each of the control points being associated with one of a plurality of components of the audio signal, and absolute values for each of a plurality of parameters for each of the plurality of control points, comprising the steps of:

dividing the audio signal into a plurality of time slices, each of the plurality of time slices having a start point and an end point, the start point and the end point corresponding to control points that are adjacent in time; and for each particular time slice of the plurality of time slices:

defining a plurality of interim points between the start point and the end point of the particular time slice, the number of interim points being proportional to the difference between the absolute values of the start point and the end point of a selected parameter of the plurality of parameters;

defining a plurality of step deltas, each step delta being associated with one of the plurality of parameters;

providing a plurality of start point outputs, each start point output being associated with one of the plurality of parameters, the value of each start point output being equal to the absolute value of the start point of the associated parameter;

providing a plurality of first interim point outputs, each first interim point output being associated with one of the plurality of parameters, the value of each first interim point output being equal to the sum of the start point output and the step delta of the associated parameter;

successively providing a plurality of next interim point outputs, each next interim point output being associated with one of the plurality of parameters, the value of each next interim point output being equal to the sum of a previous point output and the step delta of the associated parameter; and providing a plurality of end point outputs, each end point output being associated with one of the plurality of parameters, the value of each end point output being equal to the absolute value of the end point of the associated parameter.

36. The method of claim 35, wherein digital data includes a sample rate, and the step of defining a plurality of interim points between the start point and the end point of each particular time slice comprises the steps of:

determining the slope of a line for each particular parameter of the plurality of parameters by dividing the difference between the absolute values associated with the start point and the end point for the particular parameter by the length of the particular time slice;

determining the number of samples at the sample rate for each particular parameter to change a predetermined indiscernible amount based on the slope of the line for that particular parameter;

selecting the minimum number of samples as a step duration; and defining an interim point in the particular time slice at every step duration from the start point to the end point.

37. The method of claim 36, wherein the step of defining a plurality of step deltas comprises the steps of:

defining a total number of steps by dividing the length of the particular time slice by the step duration; and equating the each of the plurality of step deltas to the difference between the absolute values associated with the start point and the end point for the associated parameter divided by the total number of steps.

38. The method of claim 37, wherein the plurality of signal parameters include a left volume level, a right volume level, and a pitch level, the digital information provides absolute values for each of the plurality of parameters in perceptual units, and the step of identifying a step duration further comprises the step of increasing the step duration to a minimum step duration.

39. The method of claim 38, wherein the step of dividing the audio signal into a plurality of time slices comprises the steps of:

functionally merging the plurality of control points of each of the plurality of components of the audio signal into a single time-line; and identifying a time slice for each period of time located between any two adjacent control points on the time-line.

40. The method of claim 39, wherein one component of the audio signal includes a plurality of MIDI events and the control points associated with this component include the MIDI events of note on, note off, pitch bend, and expression.

41. The method of claim 39, wherein one component of the audio signal is a volume envelope and the control points associated with the volume envelope include:

the end of a attack segment;

the end of a decay segment; and the end of a release segment.

42. The method of claim 39, wherein one component of the audio signal is a pitch envelope and the control points associated with the pitch envelope include:

the end of a attack segment;

the end of a decay segment; and the end of a release segment.

43. The method of claim 39, wherein one component of the audio signal is a sine wave generated by a low frequency oscillator and the control points associated with the sine wave include intervals of the sine wave in the range of ¼th to 1/16th wavelengths.

44. The method of claim 39, wherein one component of the audio signal includes receiving status signals from at least one external source and the control points for this component include the occurrence of a buffer full signal.

45. The method of claim 39, wherein the step of dividing the audio signal further comprises the step of subdividing the time slice into two or more smaller time slices if the length of the time slice exceeds a maximum length and the rate of change in the magnitude of at least one of the plurality of parameters exceeds a maximum rate of change associated with the length of the time slice.

46. The method of claim 39, wherein the step of dividing the audio signal further comprises the step of combining two or more adjacent time slices into a larger time slice if at least one of the time slices is not longer than a minimum length.

47. The method of claim 36, wherein the step of defining a plurality of step deltas comprises the steps of:

defining a total number of steps by dividing the length of the particular time slice by the step duration;

defining a plurality of total deltas, each total delta being associated with a particular parameter of the plurality of parameters by converting the difference between the absolute values associated with the start point and the end point for the particular parameter into linear units; and equating each step delta associated with the particular parameter to the total delta associated with the particular parameter divided by the total number of steps.

48. The method of claim 47, wherein the step of dividing the audio signal into a plurality of time slices comprises the steps of:

functionally merging the plurality of control points of each of the plurality of components of the audio signal into a single time-line; and identifying a time slice for each period of time located between any two adjacent control points on the time-line.

49. The method of claim 47, wherein one component of the audio signal includes a plurality of MIDI events and the control points associated with this component include the MIDI events of note on, note off, pitch bend, and expression.

50. The method of claim 47, wherein one component of the audio signal is a volume envelope and the control points associated with the volume envelope include:

the end of a attack segment;

the end of a decay segment; and the end of a release segment.

51. The method of claim 47, wherein one component of the audio signal is a pitch envelope and the control points associated with the pitch envelope include:

the end of a attack segment;

the end of a decay segment; and the end of a release segment.

52. The method of claim 47, wherein one component of the audio signal is a sine wave generated by a low frequency oscillator and the control points associated with the sine wave include intervals of the sine wave in the range of ¼th to 1/16th wavelengths.

53. The method of claim 47, wherein one component of the audio signal includes receiving status signals from at least one external source and the control points for this component include the occurrence of a buffer full signal.

54. The method of claim 47, wherein the step of dividing the audio signal further comprises the step of subdividing the time slice into two or more smaller time slices if the length of the time slice exceeds a maximum length and the rate of change in the magnitude of at least one of the plurality of parameters exceeds a maximum rate of change associated with the length of the time slice.

55. The method of claim 47, wherein the step of dividing the audio signal further comprises the step of combining two or more adjacent time slices into a larger time slice if at least one of the time slices is not longer than a minimum length.

56. A computer-readable medium having computer-executable instructions for providing synthesized audio by tracking the volume levels and the pitch level of an audio signal represented by a stream of digital data, by performing steps comprising:

in response to receiving a MIDI note on event in the digital data stream, the MIDI note on event indicating the start of a note, equating a start point for a time slice to the time of receipt of the MIDI note on event;

in response to invoking an articulation generator with the start point of the time slice, receiving absolute values for the volume level and the pitch level for the start point of the time slice and a plurality of control points for each of a plurality of components of the audio signal occurring after the start point of the time slice;

equating the end point of the time slice to the time of the earliest occurring next control point received in response to invoking the articulation generator with the start point of the time slice;

in response to invoking an articulation generator with the end point of the time slice, receiving absolute values for the volume levels and the pitch level for the end point of the time slice and a plurality of control points for each of a plurality of components of the audio signal occurring after the end point of the time slice; and tracking the volume levels and the pitch level by invoking a mix engine with the absolute values for the volume levels and the pitch level for the start point and the end point of the time slice, and the length of the time slice.

57. The computer-readable medium of claim 56, wherein one of the plurality of components of the audio signal include an envelope, the envelope including an attack segment, a decay segment, a sustain segment and a release segment, having further computer-executable instructions for performing the steps of:

if the control point establishing the end point of the time slice is not an end of release segment for a volume envelope, the end of release segment indicating the end of a note, equating the start point for a next time slice to the end point of the time slice and equating the absolute values for the volume levels and the pitch level associated with the start point of the next time slice to the absolute values for the volume levels and the pitch level associated with the end point of the time slice;

equating the end point of the next time slice to the time of the earliest occurring next control point received in response to invoking the articulation generator with the end point of the previous time slice;

in response to invoking an articulation generator with the end point of the next time slice, receiving absolute values for the volume levels and the pitch level for the end point of the next time slice and a plurality of control points for each of a plurality of components of the audio signal occurring after the end point of the next time slice; and tracking the volume levels and the pitch level of the next time slice by invoking the mix engine with the absolute values for the volume levels and the pitch levels for the start point and the end point of the next time slice, and the length of the next time slice.

58. The computer-readable medium of claim 57, having further computer-executable instructions for performing the mix engine steps of:

receiving the absolute values for the volume level and the pitch level for the start point and the end point of a particular time slice, the absolute values being in perceptual units;

identifying a step duration as a function of the difference between the received absolute values in perceptual units;

equating a volume total delta to the difference between the absolute value for the start point and the absolute value for the end point of the volume level;

equating a pitch total delta to the difference between the absolute value for the start point and the absolute value for the end point of the pitch level;

converting the volume total delta and the pitch total delta from perceptual units to linear units;

identifying a volume step delta and a pitch step delta for adjusting the magnitude of the volume level and the pitch level at step points between the start point and the end point of the particular time slice, the step points being located at step duration intervals between the start point and end point of the particular time slice;

setting the volume level and the pitch level associated with the start point of the particular time slice to the linear units equivalent of the received absolute values for the start point;

setting the magnitude of the volume level and the pitch level at each step point by adding respectively, the volume step delta and the pitch step delta, in linear units, to the magnitude of the volume level and the pitch level of the preceding step point; and setting the volume level and the pitch level at the end point of the particular time slice to the linear units equivalent of the received absolute volume level and pitch level for the end point.

59. The computer-readable medium of claim 58, having further computer-executable instructions for performing the articulation generator steps of:

receiving a control point identifying a particular time;

forward scanning the digital data stream for each of a plurality of components of the audio signal, the components including MIDI events, a volume envelope, a pitch envelope, a low frequency oscillator signal, and status signals from at least one external source; and identifying the next control point occurring for each of the components after the time identified in the received control point, the control points for the MIDI commands including a note-on event, a note-off event, a pitch bend event and an expression change event, the control points for the volume and pitch envelopes including points at which the linearity of the envelope in perceptual units is broken, the control points for the low frequency oscillator signal including samples taken at ⅛ wavelength intervals, and the control points for the status signals including a buffer full status signal.

60. An audio signal synthesis system for tracking the volume level and the pitch level of an audio signal, comprising:

a processing unit;

a memory storage device;

a data source for providing digital data that represents various aspects of the audio signal, the digital data including samples at a sample rate of the volume level and the pitch level of the audio signal;

a program module, stored in the memory storage device for providing instructions to the processing unit;

the processing unit, responsive to the instructions of the program module, operative to:

identify the control points for each of a plurality of components of the audio signal, each of the control points having a corresponding sample in the digital data with absolute values for the volume level and the pitch level of the audio signal at that control point;

divide the audio signal into a plurality of time slices by:

functionally merging each of the control points from each of the plurality of components into a single time-line, and identifying each period of time between two adjacent control points as a time slice;

track the volume level and the pitch level of each of the plurality of time slices by:

examining the digital data to identify a step duration for each time slice, the step duration being the minimum number of samples required for the volume level to change a first predetermined indiscernible amount of perceptual units and the number of samples for the pitch level to change a second predetermined indiscernible amount of perceptual units, equating a volume total delta to the difference between the absolute values for the volume level between the control points, equating a pitch total delta to the difference between the absolute values for the pitch level between the control points, converting the volume total delta and the pitch total delta from perceptual units to linear units, equating a volume step delta to the volume total delta divided by the total number of steps that exist in the time slice, equating a pitch step delta to the pitch total delta divided by the total number of steps that exist in the time slice, setting the volume level and the pitch level associated with the earliest control point to the corresponding absolute values, setting the magnitude of the volume level and the pitch level at each step point of the time slice by adding the appropriate step delta to the magnitude of the volume level and the pitch level for the preceding step points; and setting the volume level and the pitch level for the latest critical point of the time slice according to the corresponding absolute values.

* * * * *